US010349736B2

(12) United States Patent
Tseng et al.

(10) Patent No.: US 10,349,736 B2
(45) Date of Patent: Jul. 16, 2019

(54) TABLE ELEVATING DEVICE

(71) Applicant: TIMOTION TECHNOLOGY CO., LTD., New Taipei (TW)

(72) Inventors: Kuan-Shu Tseng, New Taipei (TW); Chung-Jen Yang, New Taipei (TW)

(73) Assignee: TIMOTION TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 15/725,276

(22) Filed: Oct. 4, 2017

(65) Prior Publication Data

US 2019/0059573 A1 Feb. 28, 2019

(30) Foreign Application Priority Data

Aug. 29, 2017 (CN) ..... 2017 2 1090501 U

(51) Int. Cl.

| | |
|---|---|
| ***A47B 9/04*** | (2006.01) |
| *A47B 21/02* | (2006.01) |
| *A47B 13/08* | (2006.01) |
| *A47B 13/10* | (2006.01) |

(52) U.S. Cl.

CPC ..... *A47B 9/04* (2013.01); *A47B 13/081* (2013.01); *A47B 13/10* (2013.01); *A47B 21/02* (2013.01); *A47B 2200/0041* (2013.01); *A47B 2200/0056* (2013.01)

(58) Field of Classification Search

CPC ..... A47B 1/03; A47B 21/0314; A47B 21/00; A47B 21/02; A47B 21/03; A47B 9/16; A47B 2021/0321; A47B 2021/0364; A47B 3/02; A47B 3/0809; A47B 3/0815; A47B 2003/025; A47B 19/08; A47B 83/02; A47B 23/001

USPC ..... 108/50.01, 50.02, 147

See application file for complete search history.

(56) References Cited

U.S. PATENT DOCUMENTS

| | | | | | |
|---|---|---|---|---|---|
| 4,440,096 | A * | 4/1984 | Rice | A47B 9/04 | 108/147 |
| 4,711,184 | A * | 12/1987 | Wallin | A47B 9/10 | 108/147 |
| 6,099,093 | A * | 8/2000 | Spence | A47B 21/03 | 108/50.01 |

(Continued)

FOREIGN PATENT DOCUMENTS

| | | | |
|---|---|---|---|
| DE | 19506897 | * | 2/1995 |
| DE | 29804853 | * | 3/1998 |
| DE | 19907606 | * | 8/2000 |

*Primary Examiner* — Janet M Wilkens

(74) *Attorney, Agent, or Firm* — Chun-Ming Shih; HDLS IPR Services

(57) ABSTRACT

A table elevating device includes: a table, formed with a bottom surface, a first side edge and a second side edge spaced away from the first side edge; a support mechanism, vertically disposed for supporting the table, and at least including an electric pushing rod used for driving the support mechanism to be elevated; a driver, served to drive the electric pushing rod to be operated via electric power; and a controller, including a case body having a first case part and a second case part and disposed on the bottom surface, and a control circuit unit electrically connected to the driver; wherein, the second case part is formed with an expansion hole oriented to face the second side edge along an extending direction defined from the interior towards the exterior.

10 Claims, 8 Drawing Sheets

(56) References Cited

U.S. PATENT DOCUMENTS 6,360,675 B1 * 3/2002 Jones ..... A47B 9/00 108/50.02
6,595,144 B1 * 7/2003 Doyle ..... A47B 9/00 108/147
6,885,796 B2 * 4/2005 Lubkert ..... G06F 1/266 312/223.3
7,377,078 B2 * 5/2008 Golino ..... A47B 87/00 108/50.01
7,430,114 B2 * 9/2008 Rouleau ..... A47B 21/00 108/50.01
7,892,148 B1 * 2/2011 Stauffer ..... A63B 22/0235 482/51
8,087,737 B2 * 1/2012 Shoenfeld ..... A47B 21/02 108/147.19
D678,847 S * 3/2013 Helm ..... D13/162
8,522,695 B2 * 9/2013 Ellegaard ..... A47B 9/00 108/144.11
9,084,475 B2 * 7/2015 Hjelm ..... A47B 9/00
D753,609 S * 4/2016 Wetzel ..... D10/49
9,703,278 B2 * 7/2017 Kristensen ..... G05B 15/02
D820,221 S * 6/2018 Yang ..... D13/164
2006/0176656 A1 * 8/2006 Sullivan ..... G06F 1/1616 361/679.26
2009/0078167 A1 * 3/2009 Ellegaard ..... A47B 9/00 108/21
2012/0126072 A1 * 5/2012 Pettersson ..... A47B 9/04 248/157
2013/0199420 A1 * 8/2013 Hjelm ..... A47B 21/00 108/20
2014/0177688 A1 * 6/2014 Chang ..... H04M 11/06 375/222
2015/0246404 A1 * 9/2015 Teraoka ..... B23K 3/08 219/129
2015/0351262 A1 * 12/2015 Jorgensen ..... H05K 5/0039 312/223.1
2016/0022031 A1 * 1/2016 Scott ..... G06F 1/181 108/50.02
2016/0238263 A1 * 8/2016 Meissner ..... F24F 13/24
2016/0309889 A1 * 10/2016 Lin ..... A47B 9/00
2018/0014097 A1 * 1/2018 Lin ..... H04R 1/025

* cited by examiner

TABLE ELEVATING DEVICE

BACKGROUND OF THE INVENTION

Field of the Invention

The present invention relates to an elevating device, especially to a table elevating device capable of being used to adjust the height of a desk surface.

Description of Related Art

A conventional device used for elevation, for example applied to adjust the height of a desk, is often driven by a motor, so that a retractable linkage rod mechanism is enabled to upwardly or downwardly displace the desk surface for allowing the height of the desk surface to be adjusted according to the actual needs, thereby meeting various requirements of users.

However, a conventional elevating desk is often provided with basic functions, or provided with other functions such as expansion or optional accessory. For the functions of expansion or optional accessory, an additional accessory is required for achieving the needs, a main control case of the elevating desk is formed with an insertion hole for the purpose of expansion, so that an objective of expanding function can be achieved through inserting the expansion or optional accessory. The conventional main control case is hidden in a location where the user cannot easily touch, the above-mentioned arrangement can prevent the main control case from being damaged by the user or other people and a better appearance can be provided while designing the desk, but the accessory is difficult to be inserted when an expansion is required. For solving the above-mentioned disadvantage, a conventional means for allowing the accessory to be inserted in an operation panel is provided, but the panel is often located close to the desk edge for allowing the user to conveniently operate, the accessory may protrude from the desk edge after being inserted, thus the operation convenience is affected or the accessory may be damaged or even broken while being accidently hit by the user.

Accordingly, the applicant of the present invention has devoted himself for improving the mentioned disadvantages.

SUMMARY OF THE INVENTION

The present invention is to provide a table elevating device, which has advantages of allowing an expansion accessory to be inserted without causing the problems existed in the prior art, and the expansion accessory can be prevented from being exposed and affecting the appearance and can also be protected from being hit or damaged.

Accordingly, the present invention provides a table elevating device, which comprises a table, a support mechanism, a driver and a controller; the table is formed with a bottom surface, a first side edge formed at one side of the bottom surface and a second side edge formed at another side of the bottom surface, wherein the first side edge is spaced away from the second side edge; the support mechanism is vertically disposed for supporting the table, and at least includes an electric pushing rod used for driving the support mechanism to be elevated; the driver is served to drive the electric pushing rod to be operated via electric power; the controller includes a case body and a control circuit unit disposed in the case body, the case body is disposed on the bottom surface of the table and arranged to be close to the first side edge, and the control circuit unit is electrically connected to the driver; wherein, the case body includes a first case part and a second case part, the second case part is arranged at an opposite side with respect to the first case part and the second case part is formed with an expansion hole, and the expansion hole is oriented to face the second side edge of the table along an extending direction defined from the interior towards the exterior.

DETAILED DESCRIPTION OF THE INVENTION

Preferred embodiments of the present invention will be described with reference to the drawings.

Figure 1:
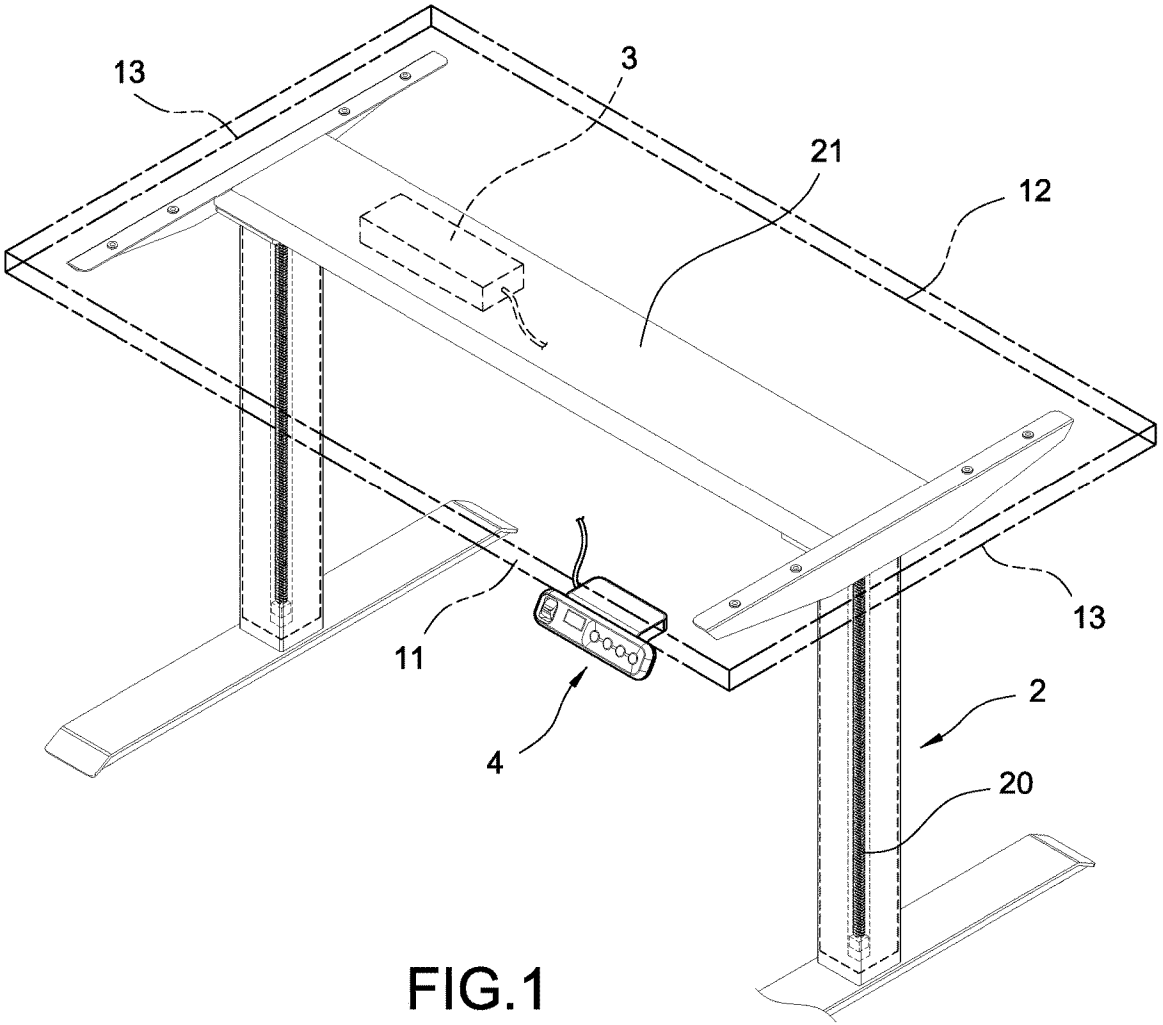
FIG. 1 is a perspective view according to the present invention.

Please refer to FIG. 1, which is a perspective view according to the present invention. A table elevating device comprising a table 1, a support mechanism 2, a driver 3 and a controller 4 is provided by the present invention.

Figure 5:
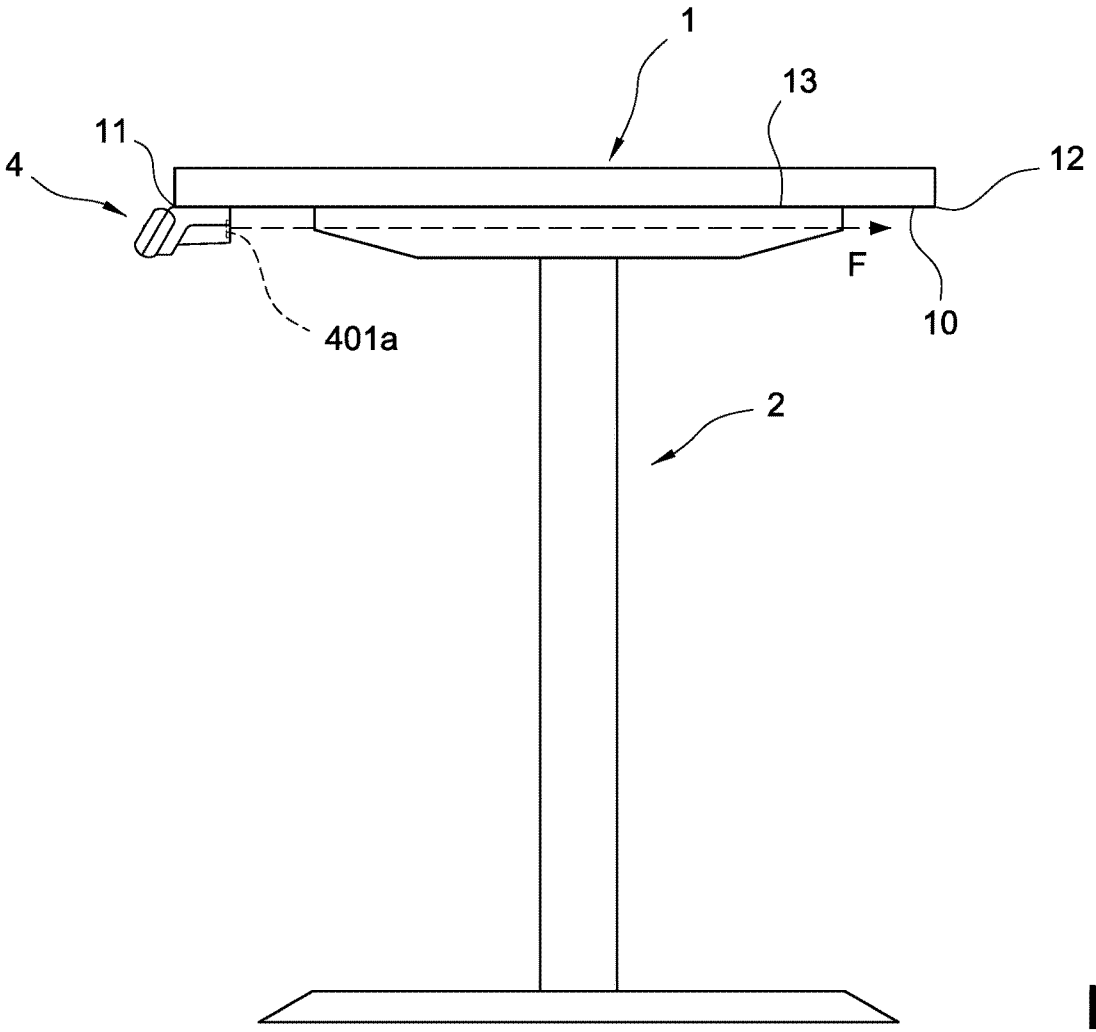
FIG. 5 is a plane side view according to the present invention.

The table 1 can be served as a desk surface, a top surface thereof allows a user to use, and the table 1 is formed with a bottom surface 10 (as shown in FIG. 5) for allowing the above-mentioned components to be disposed thereon. The table 1 is formed with a first side edge 11 arranged at one side of the bottom surface 10, and a second side edge 12 arranged at another side of the bottom surface 10; according to this embodiment, the bottom surface 10 is further formed with two third side edges 13 arranged between the first side edge 11 and the second side edge 12, so that the first side edge 11 is spaced away from the second side edge 12.

As shown in FIG. 1, the support mechanism 2 is vertically disposed for supporting the table 1, and the support mechanism 2 at least includes an electric pushing rod 20. The electric pushing rod 20 is driven by the driver 3 via electric power so as to be operated, thus the support mechanism 2 can be driven to be elevated or descended for adjusting the height of the table 1.

Figure 2:
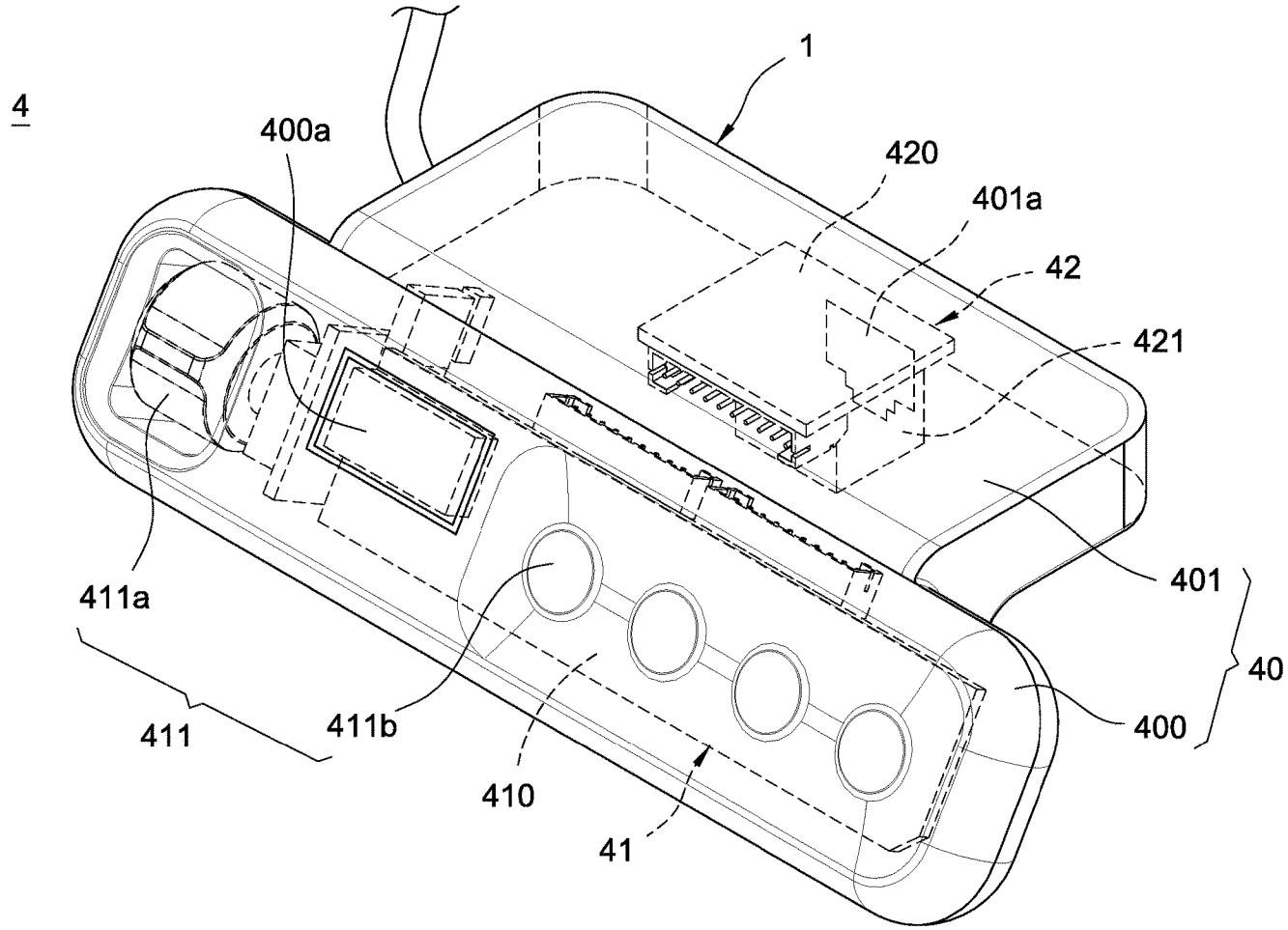
FIG. 2 is a perspective view showing a controller according to the present invention.
Figure 3:
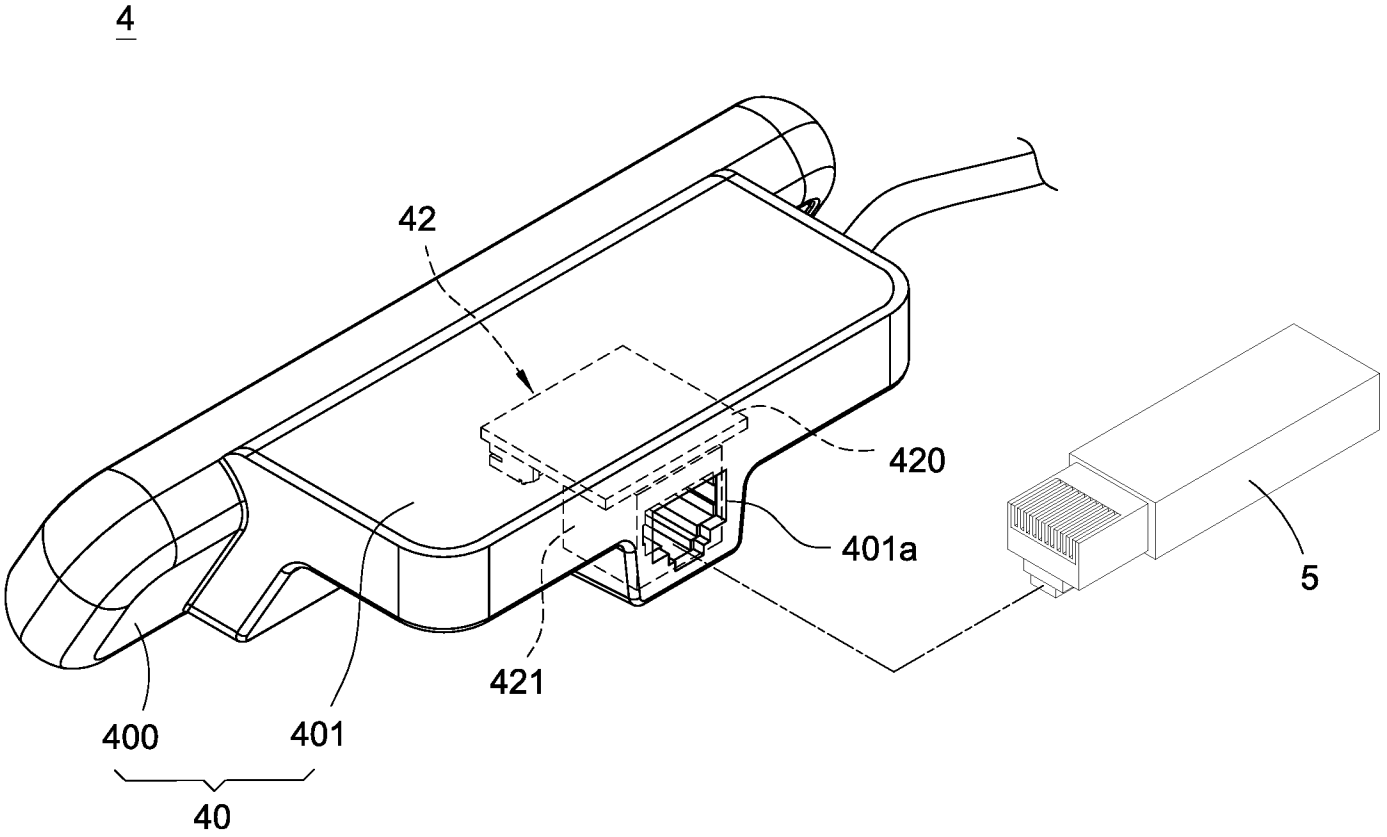
FIG. 3 is another perspective view showing the controller according to the present invention.

Please refer to FIG. 2 and FIG. 3, the controller 4 includes a case body 40 and a control circuit unit 41 disposed in the case body 40. The controller 4 is disposed on the bottom surface 10 of the table 1 and arranged to be close to the first side edge 11, and the control circuit unit 41 is electrically connected to the driver 3 via a wiring means. Details are provided as follows. The case body 40 includes a first case part 400 and a second case part 401. The control circuit unit 41 includes a control circuit board 410 and a plurality of control buttons 411 disposed on the control circuit board 410, the plural control buttons 411 are partially exposed on the first case part 400 for allowing a user to operate. The control buttons 411 can be rotary buttons 411*a* and press buttons 411*b* which are selectively adopted with respect to the actual needs. In addition, the control circuit board 410 is electrically connected to the driver 3, so that when the user operates the control buttons 411, the driver 3 can be correspondingly operated. Moreover, the controller 4 further includes a display screen 400*a*, the display screen 400*a* is disposed on the first case part 400 and arranged at the same side as the plural control buttons 411, so that relevant operating information can be displayed for allowing the user to view during the operation.

The second case part 401 is arranged at an opposite side with respect to the first case part 400, and the first case part 400 and the second case part 401 can be integrally formed. An expansion hole 401*a* is formed on the second case part 401, and an expansion circuit unit 42 is disposed inside the second case part 401. The expansion circuit unit 42 includes an expansion circuit board 420 and an expansion connector 421 disposed on the expansion circuit board 420, the expansion connector 421 is corresponding to the expansion hole 401*a* and allows an expansion accessory 5 to be connected to the expansion connector 421 via the expansion hole 401*a*. The expansion connector 421 can be a connector with RJ specification, and the expansion accessory 5 can be served to expand the function of the controller 4 via a wireless transferring means such as a Bluetooth or WiFi.

Figure 4:
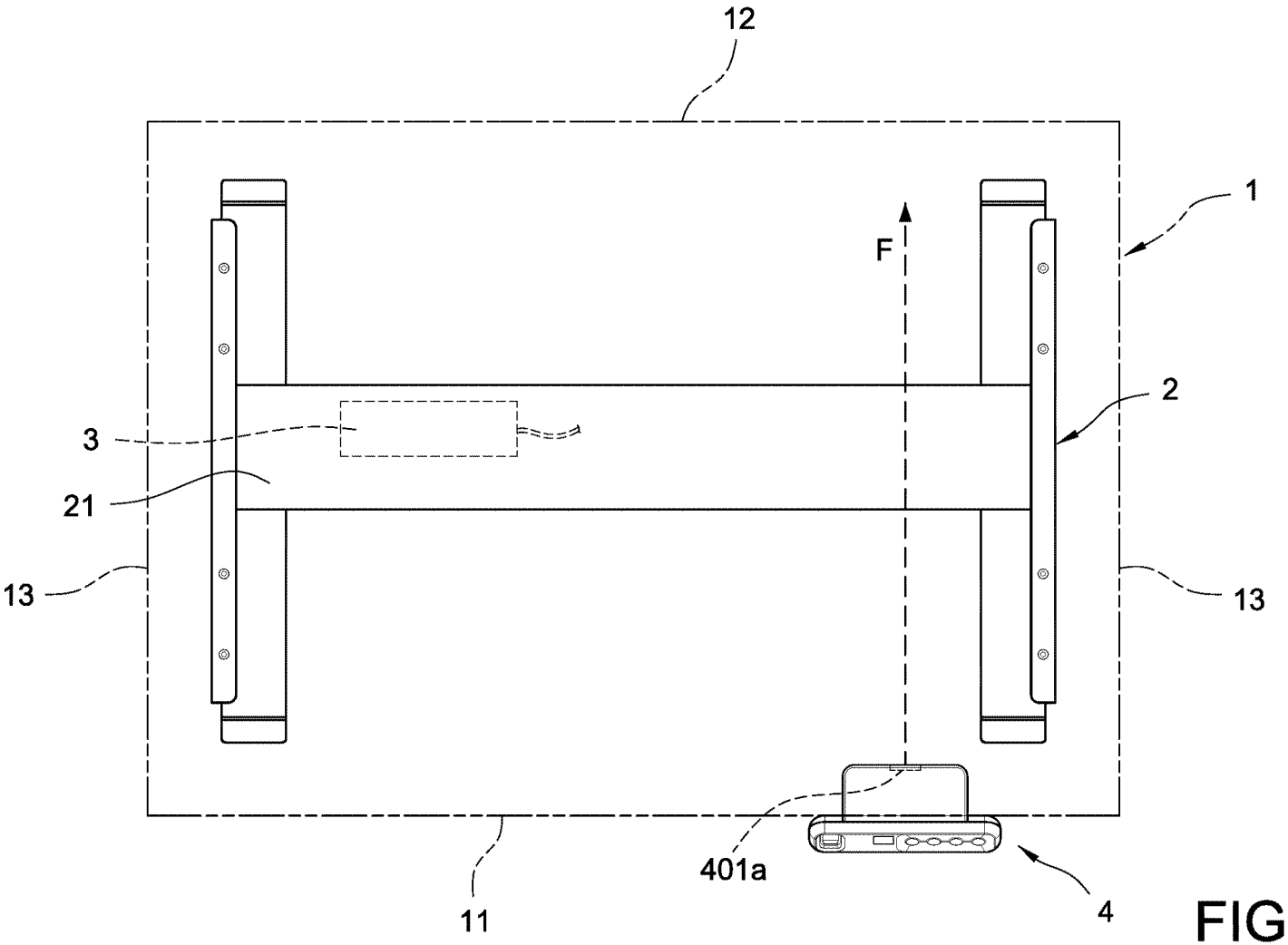
FIG. 4 is a plane top view according to the present invention.
Figure 6:
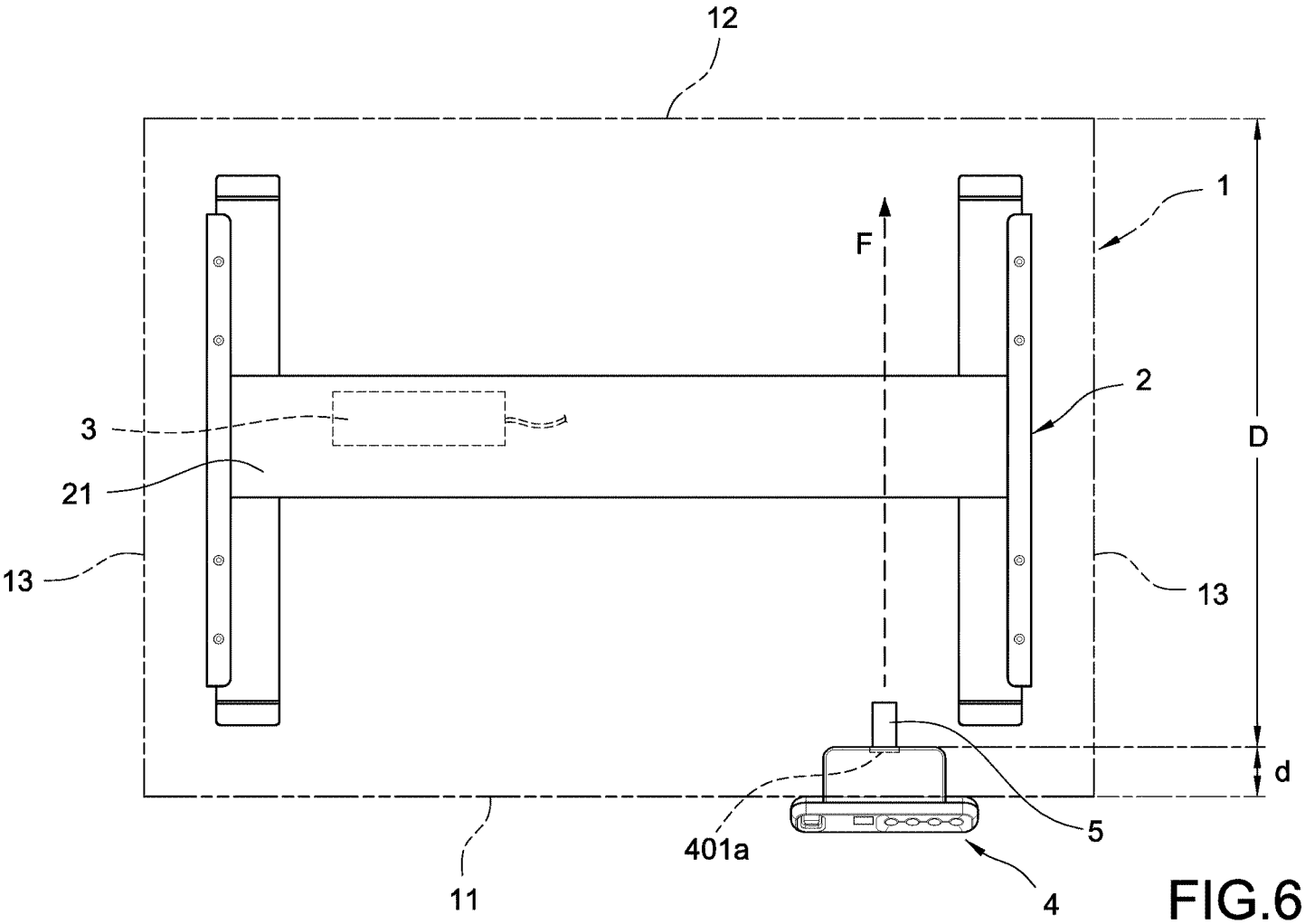
FIG. 6 is a plane top view showing an expansion accessory being inserted according to the present invention.

Please refer to FIG. 4 and FIG. 5, which disclose one embodiment of the present invention; the first side edge 11 of the table 1 is in a linear status, and the controller 4 can be disposed at any desired location close to the first side edge 11, so that the expansion hole 401*a* is able to be oriented to face the second side edge 12 of the table 1 along an extending direction F defined from the interior of the case body 40 towards the exterior and perpendicular to the second side edge 12 after being extended. Moreover, the support mechanism 2 is disposed between the two third side edges 13 of the table 1, and a supporter 21 is provided on the bottom surface 10 of the table 1 for connecting the two support mechanisms 2, and the extending direction F is defined as firstly passing the supporter 21 then being perpendicular to the second side edge 12. Please refer to FIG. 6, with the above-mentioned arrangement, a minimum distance d defined from a hole edge of the expansion hole 401*a* to the first side edge 11 is obviously much smaller than a minimum distance D defined from the expansion hole 401*a* to the second side edge 12; as such, when the expansion accessory 5 is inserted in the expansion hole 401*a* and connected to the expansion connector 421, the assembly for expansion can be simply achieved through the arm of the user to reach the above-mentioned distance d, and a sufficient space can be provided by the above-mentioned distance D for hiding the expansion accessory 5, so that the operation on the table 1 would not be affected and a situation of accidently hitting the expansion accessory 5 can be avoided.

Figure 7:
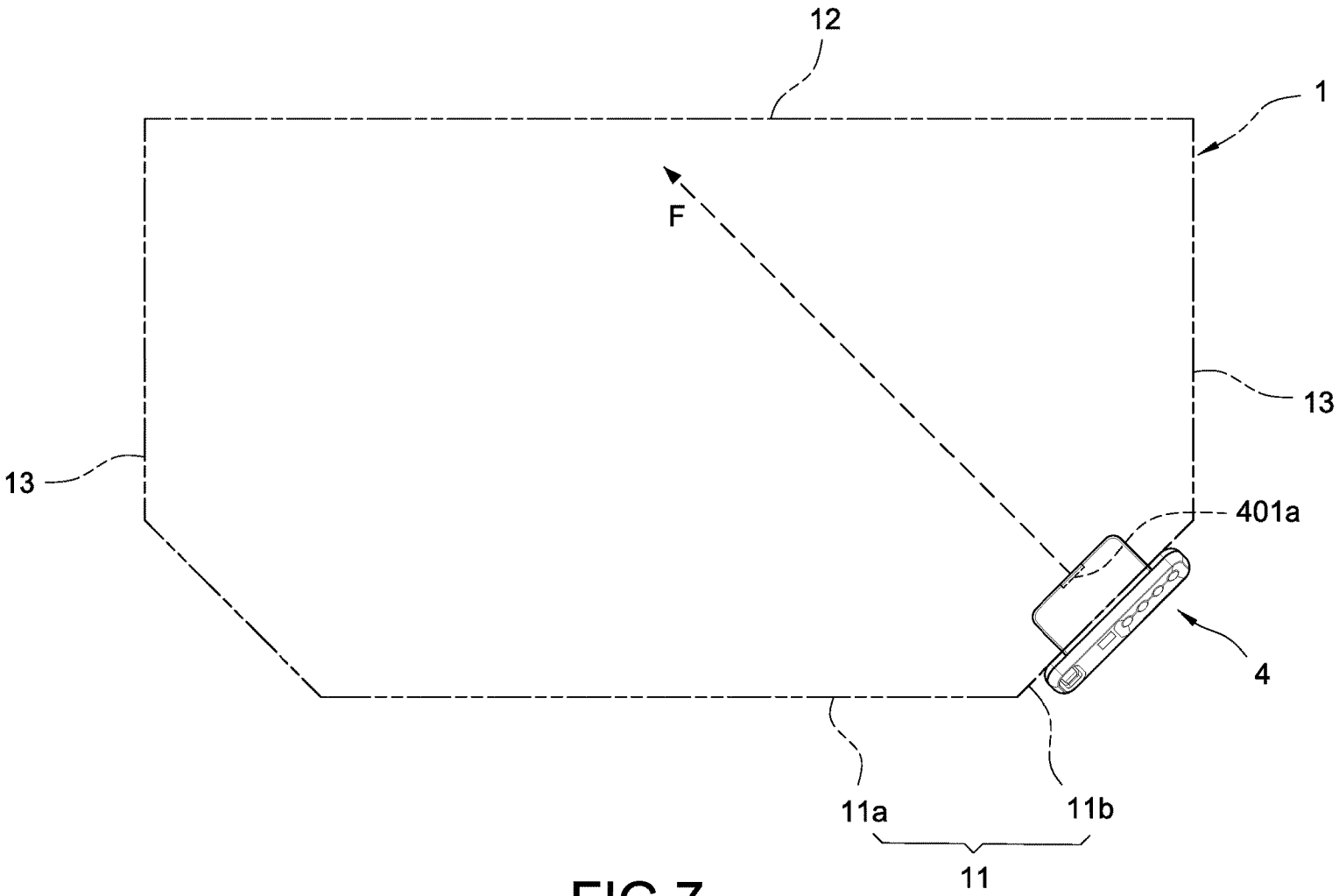
FIG. 7 is a plane top view according to another embodiment of the present invention.
Figure 8:
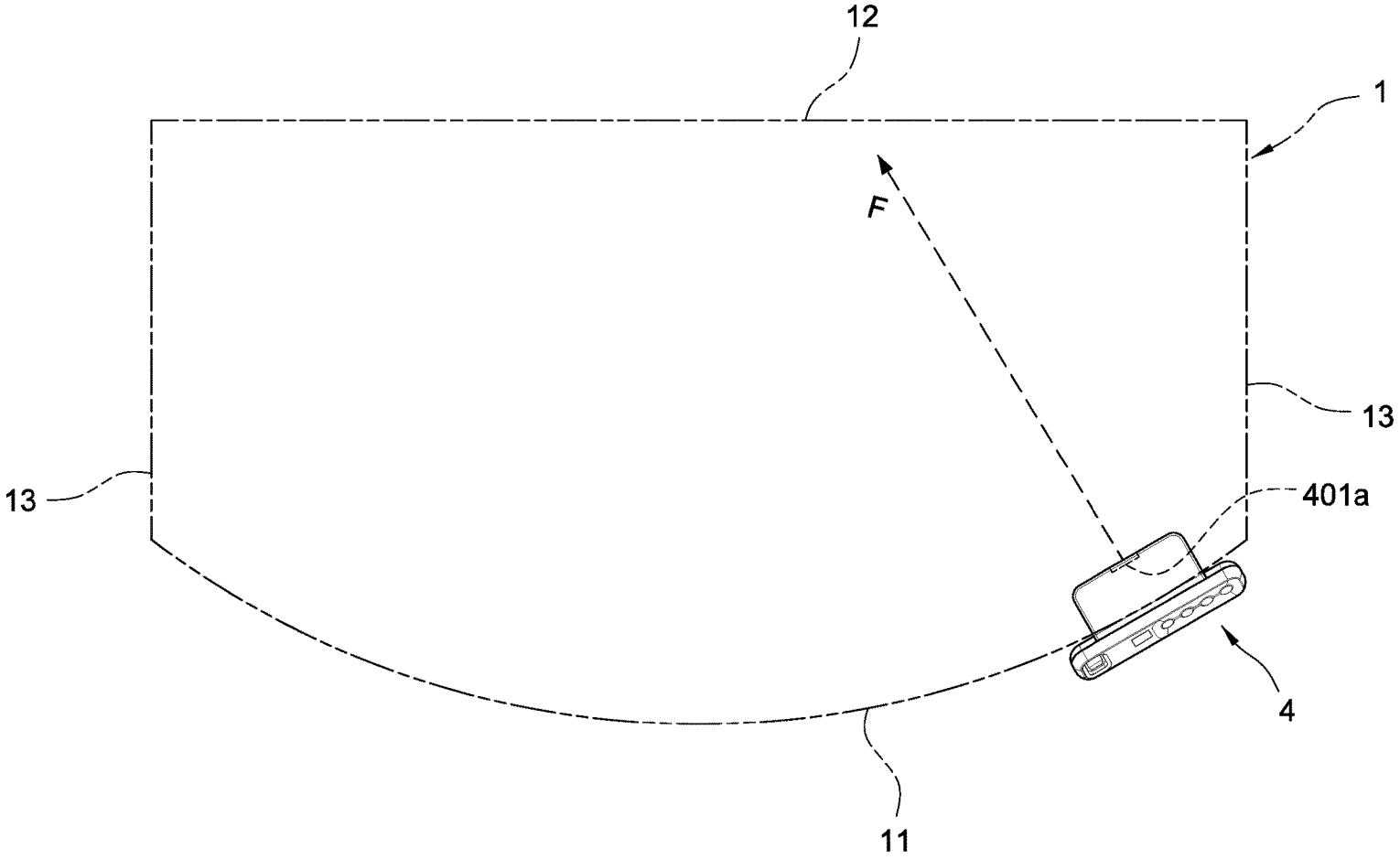
FIG. 8 is a plane top view according to one another embodiment of the present invention.

Please refer to FIG. 7, according to another embodiment of the present invention, the first side edge 11 of the table 1 can be divided into a linear front edge 11*a* and at least an inclined edge 11*b* at one side of the front edge 11*a*, and the two third side edges 13 on the bottom surface 10 of the table 1 are arranged between the inclined edge 11*b* and the second side edge 12. Accordingly, the controller 4 can still be disposed at any desired location close to the inclined edge 11*b*, and the inclined edge 11*b* is relatively spaced from the second side edge 12. Please refer to FIG. 12, according to one another embodiment of the present invention, the first side edge 11 of the table 1 is formed in an arc-shaped status, when the controller 4 is disposed at any desired location close to the first side edge 11, the controller 4 is still relatively spaced from the second side edge 12. As such, according to the two embodiments, there is an enough space for hiding the expansion accessory 5, so that the expansion accessory 5 can be prevented from being exposed and protected from being hit or even damaged.

With the above-mentioned structure, the table elevating device of the present invention is assembled.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A table elevating device, comprising:

a table, formed with a bottom surface, a first side edge formed at one side of the bottom surface and a second side edge formed at another side of the bottom surface, wherein the first side edge is spaced away from the second side edge;

a support mechanism, disposed for supporting the table at a vertical direction, and at least including an electric pushing rod used for driving the support mechanism to be elevated;

a driver, served to drive the electric pushing rod to be operated via electric power; and a controller, including a case body and a control circuit unit disposed in the case body, wherein the case body is disposed on the bottom surface of the table and arranged to be close to the first side edge, and the control circuit unit is electrically connected to the driver;

wherein, the case body includes a first case part and a second case part, the second case part is arranged at an opposite side with respect to the first case part and the second case part is formed with an expansion hole, and the expansion hole is oriented to face the second side edge of the table along an extending direction that is defined from the interior towards the exterior and intersects with the second side edge;

wherein the first case part is tilted outwardly to be away from the first side edge and downwardly to be away from the bottom surface, and both a length and a height of the first case part along the first side edge and the vertical direction, respectively, are larger than that of the second case part so that the second case part is concealed by viewing from the first case part.

2. The table elevating device according to claim 1, wherein the bottom surface is further formed with two third side edges arranged between the first side edge and the second side edge.

3. The table elevating device according to claim 2, wherein the first side edge of the table is divided into a linear front edge and at least an inclined edge at one side of the front edge, and the two third side edges on the bottom surface of the table are arranged between the inclined edge and the second side edge.

4. The table elevating device according to claim 2, wherein the amount of the support mechanism is two, and the two support mechanisms are disposed at the two third side edges of the table, a supporter is provided on the bottom surface of the table for connecting the two support mechanisms, and the extending direction is defined as passing the supporter then being perpendicular to the second side edge.

5. The table elevating device according to claim 1, wherein a minimum distance defined from a hole edge of the expansion hole to the first side edge is smaller than a minimum distance defined from the expansion hole to the second side edge.

6. The table elevating device according to claim 1, wherein the controller further includes a display screen.

7. The table elevating device according to claim 1, wherein the control circuit unit includes a control circuit board and a plurality of control buttons disposed on the control circuit board, and the plural control buttons are partially exposed on the first case part.

8. The table elevating device according to claim 7, wherein the control buttons are rotary buttons and press buttons.

9. The table elevating device according to claim 1, wherein an expansion circuit unit is disposed in the second case part, the expansion circuit unit includes an expansion circuit board and an expansion connector disposed on the expansion circuit board, the expansion connector is corresponding to the expansion hole and allows an expansion accessory to be connected to the expansion connector via the expansion hole.

10. The table elevating device according to claim 9, wherein the expansion connector is a connector with RJ specification.

* * * * *